US012398945B2

(12) United States Patent
Schneider et al.

(10) Patent No.: US 12,398,945 B2
(45) Date of Patent: Aug. 26, 2025

(54) REFRIGERATOR

(71) Applicant: Hettich-ONI GmbH & Co. KG, Vlotho (DE)

(72) Inventors: Mark Schneider, Porta Westfalica (DE); Ralf Tofall, Bueckeburg (DE)

(73) Assignee: Hettich-ONI GmbH & Co. KG, Vlotho (DE)

( * ) Notice: Subject to any disclaimer, the term of this patent is extended or adjusted under 35 U.S.C. 154(b) by 180 days.

(21) Appl. No.: 18/029,152

(22) PCT Filed: Sep. 6, 2021

(86) PCT No.: PCT/EP2021/074492
§ 371 (c)(1),
(2) Date: Mar. 29, 2023

(87) PCT Pub. No.: WO2022/069159
PCT Pub. Date: Apr. 7, 2022

(65) Prior Publication Data

US 2023/0366610 A1 Nov. 16, 2023

(30) Foreign Application Priority Data

Sep. 30, 2020 (DE) ..... 10 2020 125 600.0

(51) Int. Cl.
*F25D 23/02* (2006.01)
*F25D 23/06* (2006.01)

(52) U.S. Cl.
CPC ..... *F25D 23/028* (2013.01); *F25D 23/063* (2013.01)

(58) Field of Classification Search
CPC ..... F25D 23/028; F25D 23/063; F25D 2323/024; E05Y 2900/31
(Continued)

(56) References Cited

U.S. PATENT DOCUMENTS 4,084,291 A * 4/1978 Crowe ..... E05D 3/04 49/382
5,158,503 A * 10/1992 Mitchell ..... E05D 3/12 16/302

(Continued)

FOREIGN PATENT DOCUMENTS

DE 10 2010 027 922 A1 10/2011
EP 2 754 982 A1 7/2014

(Continued)

OTHER PUBLICATIONS

International Search Report in PCT/EP2021/074492, mailed Jan. 5, 2022.

(Continued)

*Primary Examiner* — James O Hansen
(74) *Attorney, Agent, or Firm* — Collard & Roe, P.C.

(57) ABSTRACT

A refrigerator has an appliance body on which at least two doors arranged one above the other are pivotably mounted. The doors are mounted via a double hinge which is fixed to the appliance body with a mounting plate which is connected via a plurality of movable joint levers to an upper hinge part connected to the upper door and to a lower hinge part connected to the lower door via a plurality of further movable joint levers. The upper door is further pivotably mounted on the appliance body via a support hinge which is fixed to the appliance body by a mounting element that is connected to a plurality of joint levers connected to a further hinge part connected to the upper door. The joint levers of the support hinge have a greater vertical extent in the vertical direction than the joint levers of the double hinge.

17 Claims, 15 Drawing Sheets

(58) Field of Classification Search
USPC ..... 312/405
See application file for complete search history.

(56) References Cited

U.S. PATENT DOCUMENTS

| | | | | |
|---|---|---|---|---|
| 2010/0244646 | A1* | 9/2010 | Laible | F25D 23/10 312/405 |
| 2012/0080991 | A1* | 4/2012 | Wilson | F25D 23/028 312/405 |
| 2022/0018591 | A1 | 1/2022 | Kikuchi | |

FOREIGN PATENT DOCUMENTS

| | | | | |
|---|---|---|---|---|
| WO | 2017/089340 | A1 | 6/2017 | |
| WO | WO 2018075094 | * | 4/2018 | E05D 3/18 |
| WO | 2019/117236 | A1 | 6/2019 | |
| WO | 2020/116833 | A1 | 6/2020 | |

OTHER PUBLICATIONS

German Search Report dated Feb. 23, 2021 in German Application No. 10 2020 125 600.0 with English translation of relevant parts.

* cited by examiner

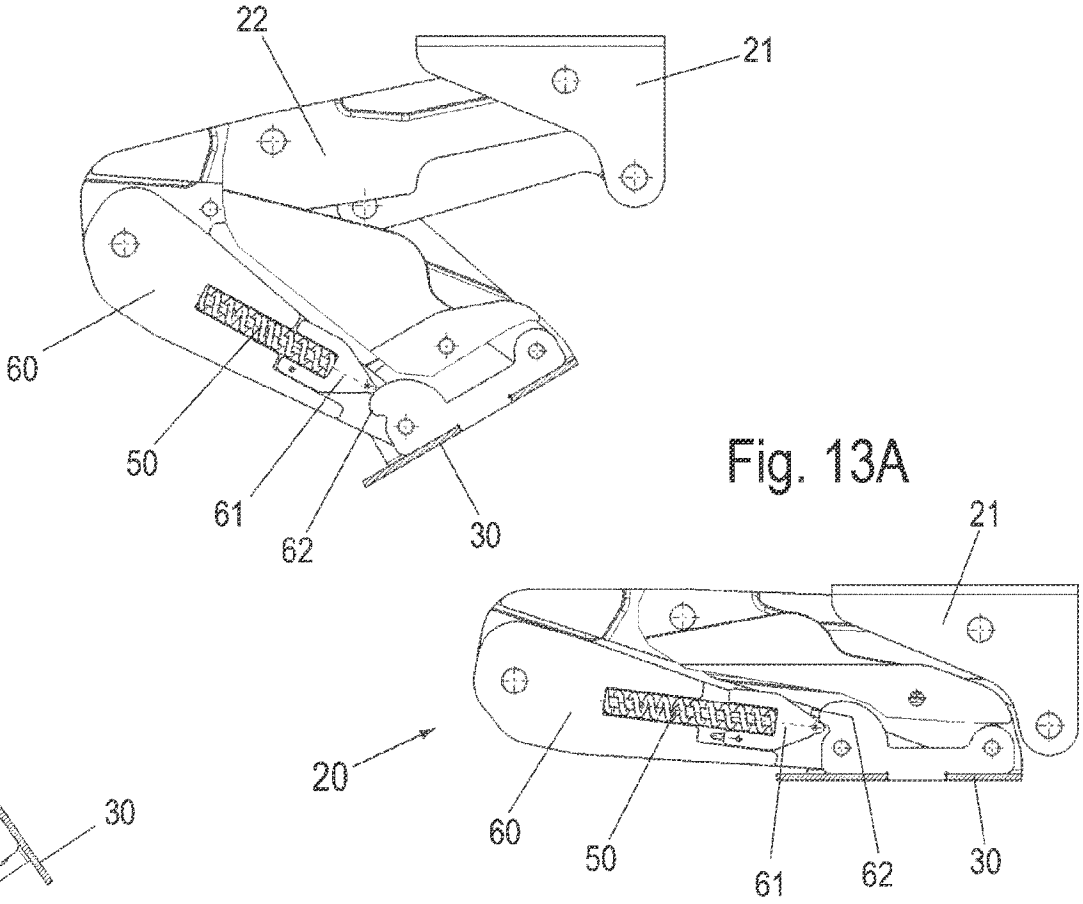
Fig. 13B
Fig. 13A
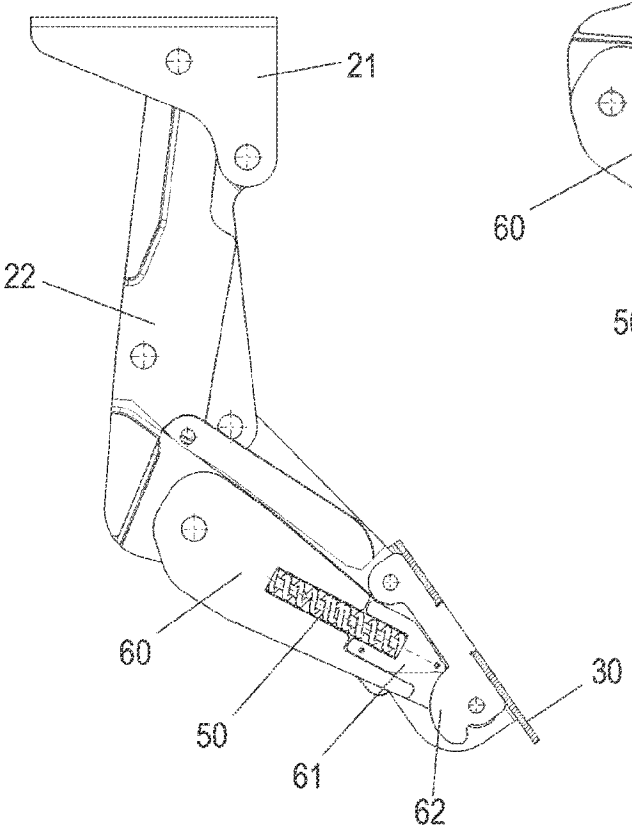
Fig. 13C

REFRIGERATOR

CROSS REFERENCE TO RELATED APPLICATIONS

This application is the National Stage of PCT/EP2021/074492 filed on Sep. 6, 2021, which claims priority under 35 U.S.C. § 119 of German Application No. 10 2020 125 600.0 filed on Sep. 30, 2020, the disclosure of which is incorporated by reference. The international application under PCT article 21(2) was not published in English.

BACKGROUND OF THE INVENTION

1. Field of the Invention

The present invention relates to a refrigerator having an appliance body on which at least two doors arranged one above the other are pivotably mounted, which doors open or close an interior space of the appliance body, the doors being connected to the appliance body in the closed position via at least one seal, the two doors being pivotably mounted via a double hinge which is fixed to the appliance body with a mounting plate, which is connected via a plurality of movable joint levers to an upper hinge part connected to the upper door and via a plurality of further movable joint levers to a lower hinge part connected to the lower door, and the upper door is pivotably mounted on the appliance body via a support hinge which is fixed to the appliance body by a mounting element which is connected via a plurality of joint levers to an upper hinge part connected to the upper door.

2. The Prior Art

EP 2 754 982 A1 discloses a refrigerator in which two doors arranged one above the other are pivotably mounted on a body. The middle hinge between the doors is designed as a double hinge, which has only one mounting element that is fixed to the body, but two movable hinge parts, so that the upper hinge part holds the upper door and the lower hinge part holds the lower door. The disadvantage of this refrigerator is that the use of the double hinge means that the gap between the upper door and the lower door is comparatively large. The relatively large volume of the double hinge leads to disadvantages with regard to the insulation of the refrigerator and also to poor utilisation of the installation space.

WO 2019/117236 A1 shows a refrigerator in which two doors are held pivotably by a double hinge. Here, too, the large vertical extension of the double hinge leads to a loss of storage space and increases the cost of insulation.

SUMMARY OF THE INVENTION

It is therefore an object of the present invention to provide a refrigerator in which two doors are pivotably mounted on an appliance body in an improved manner.

This object is achieved with a refrigerator having the features of claim 1.

The refrigerator according to the invention comprises at least two doors arranged one above the other which open or close an interior space of the appliance body. The two doors are pivotably mounted by means of a double hinge which is fixed to the appliance body with a mounting plate which is connected to an upper hinge part connected to the upper door with a plurality of movable joint levers and to a lower hinge part connected to the lower door with a plurality of further movable joint levers. Thus, a pivotable mounting of both doors can be achieved via the fixing of the mounting plate. The term "mounting plate" does not require a plate-shaped design, and it is sufficient if the mounting plate has a plate-shaped section.

The upper door is further pivotably mounted on the appliance body via a support hinge which is fixed to the appliance body with a mounting element which is connected to an upper hinge part connected to the upper door with several joint levers. According to the invention, the joint levers of the support hinge are formed in a vertical direction with a greater extension in height than the joint levers of the double hinge. As a result, higher weight loads can be absorbed via the support hinge than via the hinge part of the double hinge coupled to the support hinge, which serves to guide the upper door in the lower area, but can be very compact due to the rather thin design of the joint levers in the vertical direction. As a result, the double hinge with the narrow joint levers requires less installation space and enables improved insulation of the appliance body, as only a smaller area of the installation space is occupied by the double hinge.

A joint lever of the double hinge or the support hinge is an elongated component that is articulated via at least two axes. Each joint lever can be a single piece or composed of several parts. The distance between two end rotary axes determines the lever length of the joint lever.

Preferably, the support hinge absorbs more weight forces of the upper door than the hinge part of the double hinge coupled to the support hinge. The support hinge can be more stable and thus has less deflection under a weight load, so that also doors with a high weight are held securely. Due to the support of the support hinge, the hinge part of the double hinge coupled to the support hinge is loaded with weight forces to a lesser extent, preferably the weight forces acting in the vertical direction on the hinge part of the double hinge are less than half of the weight forces acting on the support hinge. This allows the upper door to support significant weights, for example between 20 kg to 80 kg door weight.

In a preferred embodiment, the joint levers of the double hinge and the joint levers of the support hinge have the same axes of rotation and the same lever lengths. The axes of rotation are imaginary vertical lines that extend through the centre of rotation of each joint lever. By providing the same pivot axes and the same lever lengths on the support hinge and the double hinge, the top door remains vertically aligned when pivoted and is moved substantially only horizontally. Alternatively, the pivot axes and/or the lever lengths may be different to modify the swing path of the door.

The joint levers of the double hinge are preferably at least partially plate-shaped, whereby at least the outer joint levers of the support hinge, preferably all joint levers, are designed as levers with a U-shaped cross-section. In this case, the levers of the support hinge can be manufactured in one piece by sheets bent into a U-shape. The joint levers of the support hinge thus have a high degree of rigidity.

The support hinge can, for example, comprise four joint levers and be formed as a seven-joint hinge. Each joint lever can be bent in a U-shape so that in a closed position the joint levers at least partially overlap each other. The support hinge can be box-shaped in the closed position, while in the maximum open position the joint levers are arranged in an extended position relative to each other and thus the upper door is held with a gap in front of the appliance body.

Preferably, the support hinge has a greater extension in the vertical direction than the entire double hinge. Optionally, further functions can be integrated into the support hinge, for example, a spring element can be provided to pretension the upper door in the closing direction. Optionally, a damping device can also be provided to slow down a closing movement of the support hinge before it reaches the closed position. The damping device can be provided in or on the support hinge. However, it is also possible that the damping device is arranged at another position. In addition, a damping device may also be provided in the area of the double hinge. The damping device or devices comprise a linear damper with a piston or a rotational damper.

The joint levers of the double hinge are at least partially formed from two plates that lie on top of each other in certain areas. This allows the individual joint levers to have a particularly flat structure, whereby the joint levers preferably do not lie against each other over the entire surface but have a step, which increases the rigidity of the joint lever. The thickness of the joint levers of the double hinge in the vertical direction is preferably less than 10 mm, in particular less than 8 mm, for example between 2 mm and 7 mm. Of course, the individual joint levers can have different thicknesses. A hollow space can be formed between the two plates of a joint lever, into which another joint lever projects at least in a folded position.

The support hinge preferably comprises a support lever hinged to the mounting element, which is one of the joint levers and has the greatest extension in the vertical direction. This support lever is preferably at least twice as thick as a lever of the double hinge which is hinged to the mounting plate and has the greatest extension in the vertical direction of the joint levers of the double hinge. When a seven-bar hinge is formed, two joint levers are usually pivotably connected to the mounting element or the mounting plate, so that the thicker joint lever of the support hinge is compared with the thicker joint lever of the double hinge in each case.

The support hinge is preferably formed as a seven-joint hinge comprising four joint levers which provide positive guidance of the hinge part relative to the mounting plate when the upper door is pivoted. Similarly, the joint levers on the double hinge are designed as a seven-joint hinge, each joint mechanism being composed of four joint levers connecting the hinge part to the mounting element. Alternatively, other types of hinges can be used for the support hinge or the double hinge, for example four-joint hinges.

To prevent engagement with the support hinge or the double hinge, covers can be provided on the top and bottom of the support hinge and the double hinge respectively to cover gaps between the joint levers. The covers can be made of a thin material, for example foil, or a thin plate, which swivel together with the joint levers.

In a preferred embodiment, the lower door of the refrigerator is connected to the appliance body in the upper area via the double hinge and in the lower area via a further support hinge. This further support hinge can be of identical construction to the support hinge with which the upper door is pivotably mounted on the appliance body. The refrigerator can comprise two doors or several doors that close off an interior space.

Preferably, at least one joint lever of the double hinge has a recess in which a spring is inserted by means of which a hinge part of the double hinge can be pretensioned in the closing direction. This makes it possible to support a closing movement and hold a door in the closed position with a compact design. The spring can act on a pivotable lever or a pusher which can be moved along a curve guide so that the spring does not act on the door in the closing direction over the entire pivoting range, but only in a predetermined opening range of the door by means of a tightening force.

To increase stability, an axis holder for the common axes is preferably arranged on the mounting element between the joint levers for the upper door and the joint levers for the lower door. The axis holder can be plate-shaped and extend parallel to the two outer walls of the mounting element. Preferably, the joint levers for the upper door and the joint levers for the lower door are held pivotably on the mounting element and the axis holder via a common axis pin. The axis holder also allows the lower joint mechanism with the lower hinge part to be omitted from the double hinge. This allows refrigerator designs to be provided with hinges where there are only upper doors and instead of the lower doors there are, for example, drawers, i.e. no lower door.

To avoid loud impact noises, the upper door and the lower door are each braked by a damping device during a closing process, whereby the damping device can comprise a linear damper with a displaceable piston or a rotary damper, for example a damper housing filled with fluid.

Preferably, the appliance body of the refrigerator is integrated in a piece of furniture with side walls, whereby the side walls of the piece of furniture protrude over the appliance body and cover at least a part of the lateral end faces of the doors from the side. This allows the unit of furniture and appliance body to be arranged in a visually appealing way. At least one door on the side facing the interior space, in addition to insulation, may also comprise compartments and/or holding means for storing objects. The support hinge can allow an opening angle of at least 115° so that the interior space is almost completely accessible from a front side.

BRIEF DESCRIPTION OF THE DRAWINGS

The invention is explained in more detail below by means of several embodiments with reference to the accompanying drawings. It is shown in.

DETAILED DESCRIPTION OF THE EMBODIMENTS

Figure 1B:
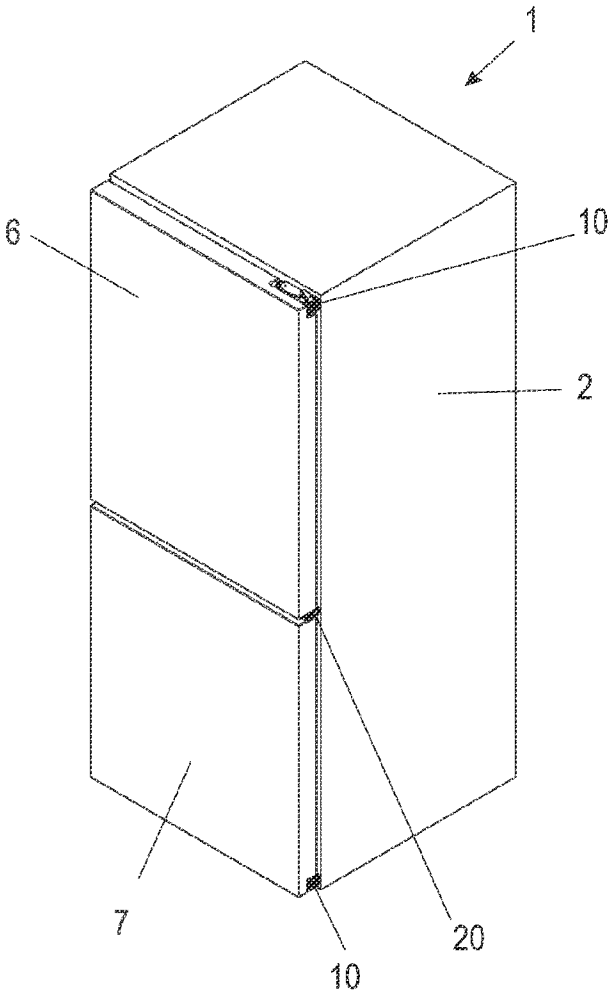
FIGS. 1A and 1B Two views of a refrigerator according to the invention.
Figure 1A:
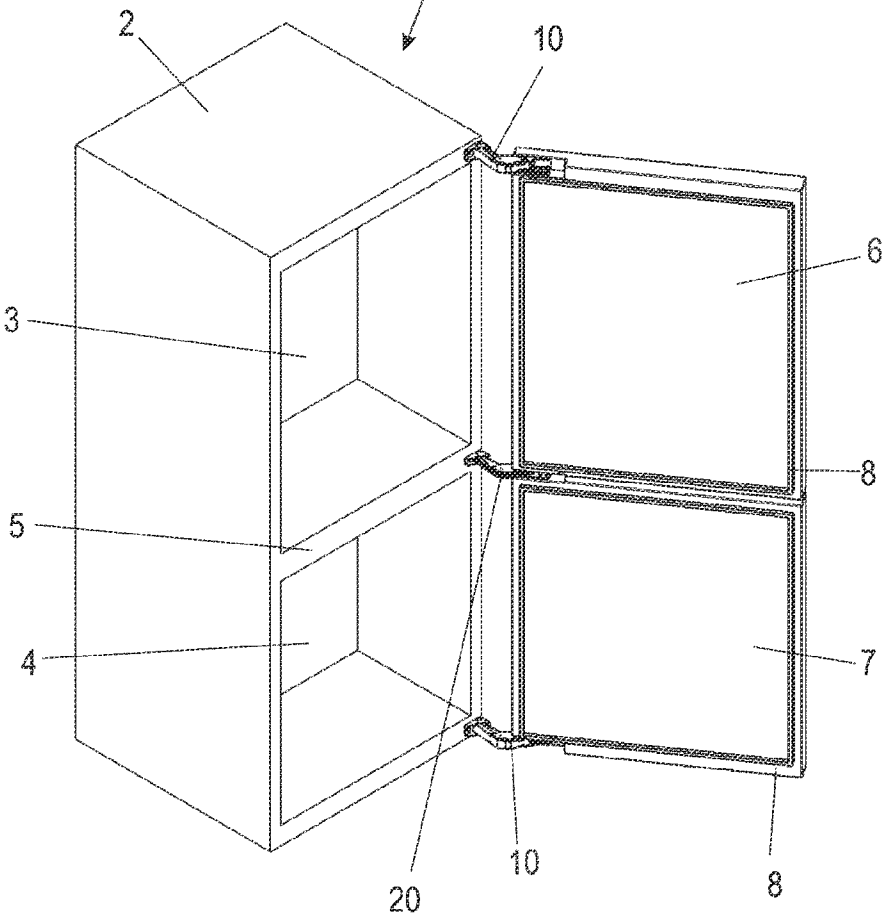

A refrigerator 1 comprises an appliance body 2 in which an upper interior space 3 and a lower interior space 4 are provided, which are separated from each other by a floor 5. The upper interior space 3 can be closed via an upper door 6, while the lower interior space 4 can be closed via a lower door 7. The doors 6 and 7 can comprise compartments and holding means for storing objects in addition to insulation on the side facing the interior spaces 3 and 4. A seal 8 is also provided on each door 6 and 7 which, in the closed position, provides a seal against the interior spaces 3 or 4.

The upper door 6 is pivotably held on the appliance body 2 via an upper support hinge 10 and an upper joint mechanism on a double hinge 20. The lower door 7 is pivotably held on the upper side by a lower joint mechanism on the double hinge 20 and on the lower side by a further support hinge 10.

Figure 2B:
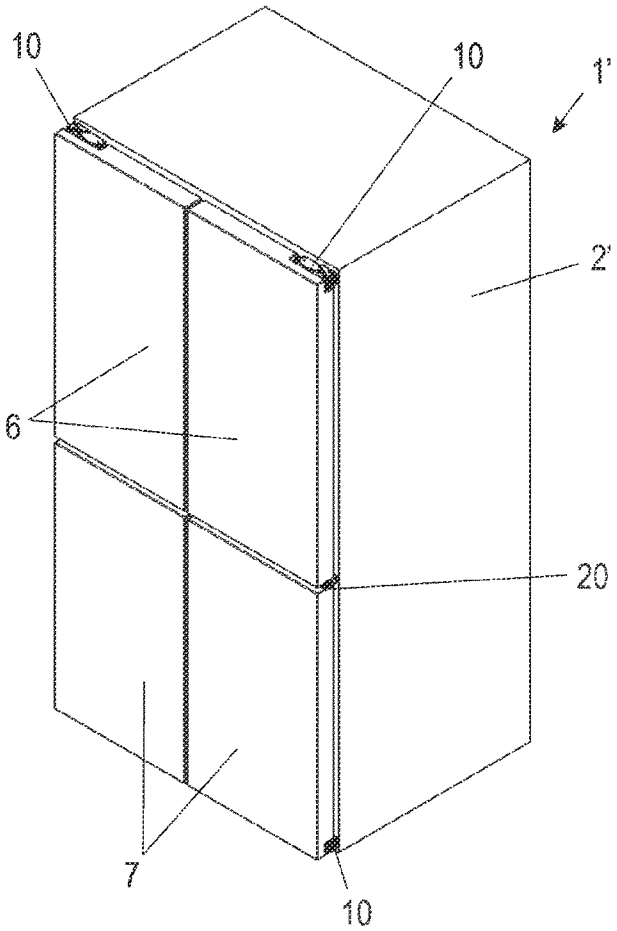
FIGS. 2A and 2B Two views of a modified refrigerator according to the invention.
Figure 2A:
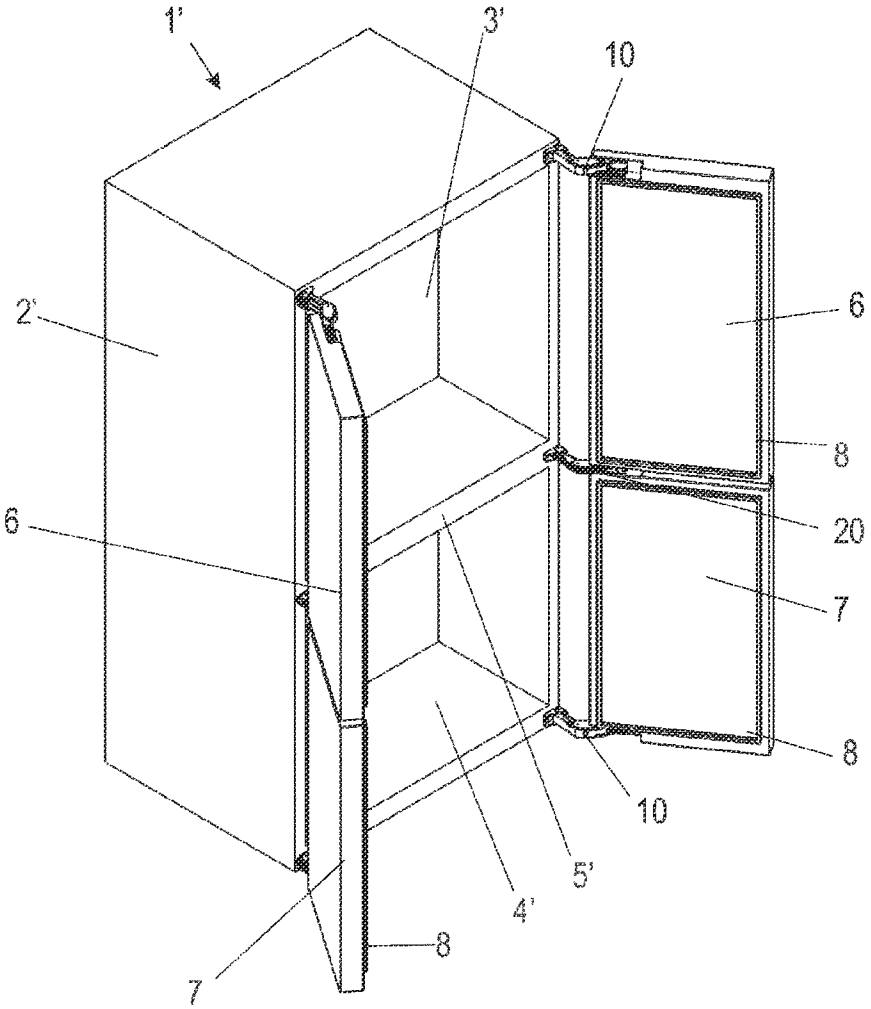

FIGS. 2A and 2B show a modified refrigerator 1' which comprises an appliance body 2' on which two upper doors 6 and two lower doors 7 are pivotably mounted. The two upper doors 6 close an upper interior space 3' in the appliance body 2', and the two lower doors 7 close a lower interior space 4'. The interior spaces 3' and 4' are divided from each other by a floor 5'. The doors 6 are each pivotably mounted at the top via a support hinge 10 and at the bottom via a double hinge 20. The lower doors 7 are pivotably mounted at the top via the double hinge 20 and at the bottom via a further support hinge 10.

The refrigerators 1 or 1' can be set up as free-standing appliances, but can also be installed within a cabinet unit. In order to avoid a collision with side walls of a cabinet unit, the support hinges 10 and the double hinge 20 are designed in such a way that a hinge part on the doors 6 and 7 is removed from the appliance body 2 or 2' during a pivoting movement.

Figure 3A:
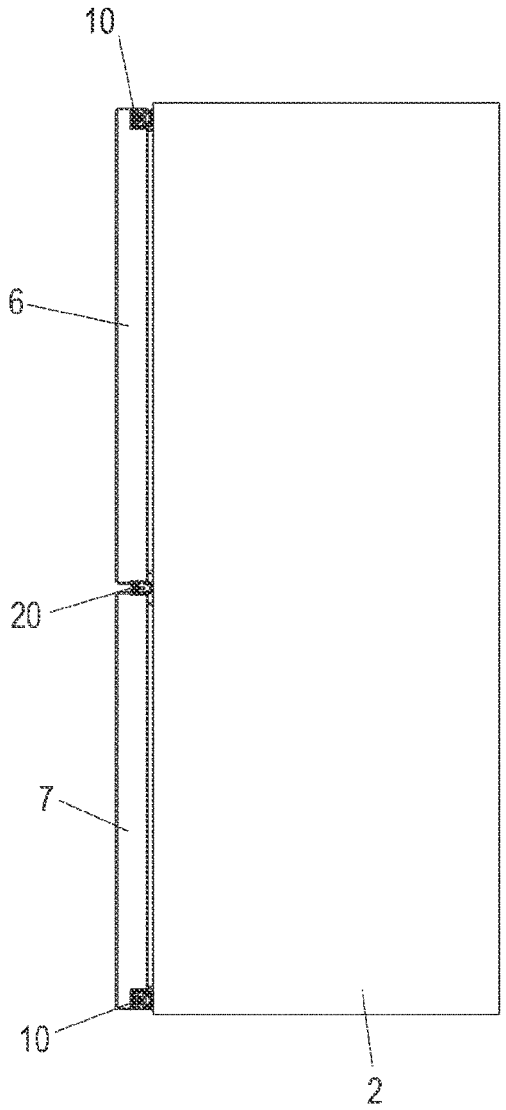
FIGS. 3A to 3C Several views of the refrigerator of FIGS. 1 and 2 in the area of the front side of the doors.
Figure 3B:
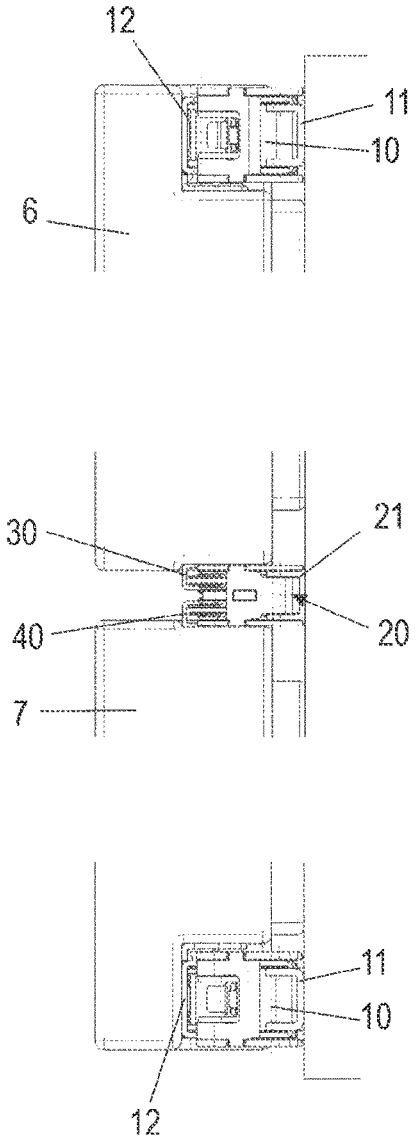
Figure 3C:
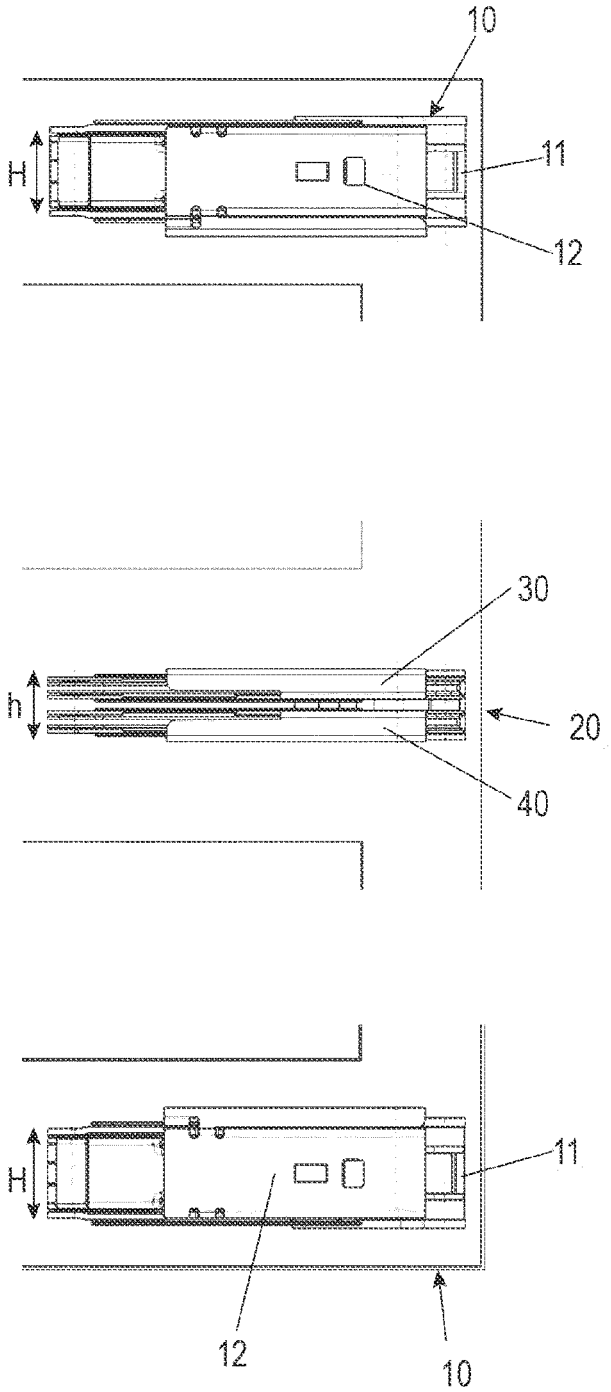

FIGS. 3A to 3C show the area of the support hinges 10 and the double hinge in detail. Each support hinge 10 is fixed to the appliance body 2 or 2' by a mounting element 11. Via an joint mechanism, the mounting element 11 is connected to a hinge part 12 on which the door 6 is held.

The double hinge 20 comprises a mounting plate 21 which is fixed to the appliance body 2 or 2'. The mounting plate 21 does not have to be formed plate-shaped, but can also have a different geometry. The mounting plate 21 is connected to an upper hinge part 30 via a joint mechanism and to a lower hinge part 40 via a further joint mechanism. The upper hinge part 30 is fixed to the door 6, while the lower hinge part 40 is fixed to the door 7.

The double hinge 20 has a height h in the vertical direction that is smaller than the height H of a support hinge 10. The double hinge 20 thus has a very compact design and ensures small gaps between the doors 6 and 7 as well as effective insulation.

Figure 4A:
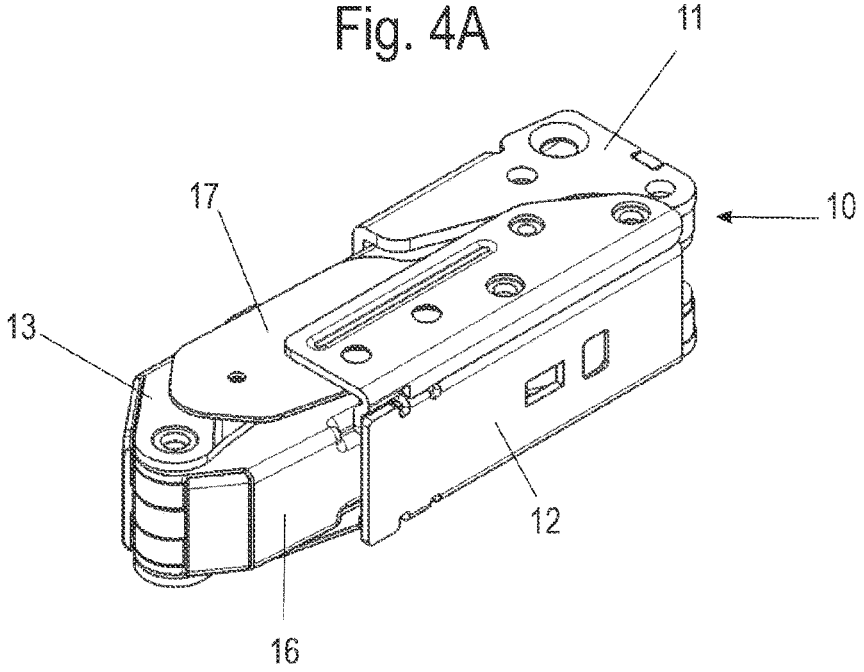
FIGS. 4A to 4C Several views of a support hinge of the refrigerator.
Figure 4B:
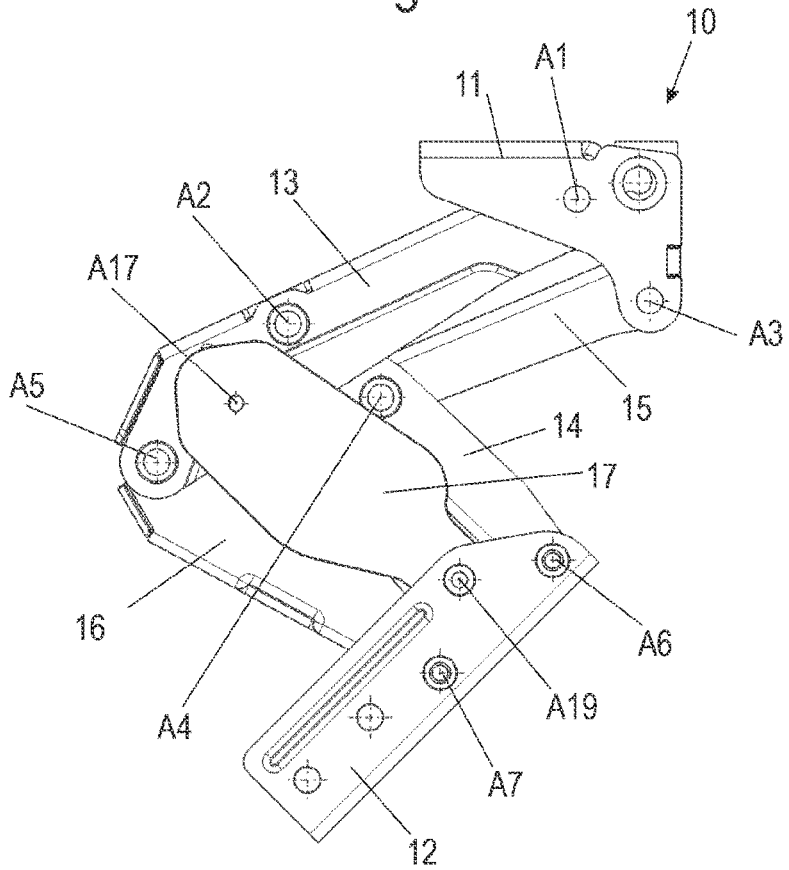
Figure 4C:
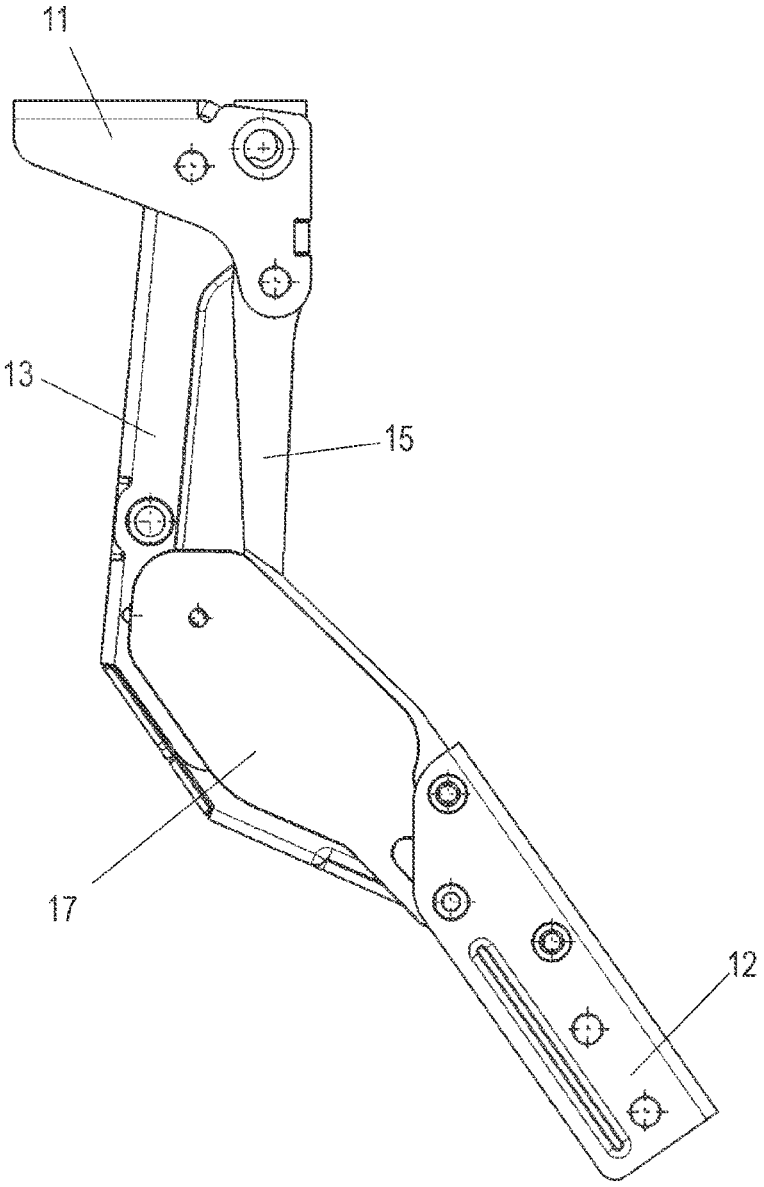

FIGS. 4A to 4C show one of the support hinges 10 in various positions. In the folded closed position shown in FIG. 4A, the support hinge 10 is essentially box-shaped, with the hinge part 12 and the mounting element 11 arranged next to each other. When the support hinge 10 is moved in an opening direction, the hinge part 12 pivots in the opening direction via a joint mechanism, as shown in FIG. 4B. The mounting element 11 is connected via two joint levers 13 and to two further joint levers 14 and 16, which in turn are articulated to the hinge part 12. In order to prevent engagement in the gaps between the joint levers 13, 14, 15 and 16, a cover 17 is provided on the upper side and the lower side respectively, which covers gaps between the joint levers 13 to 16. The support hinge 10 is designed as a seven-joint hinge and has four joint levers 13 to 16, although other hinges, for example four-joint hinges, can also be used.

Figure 5:
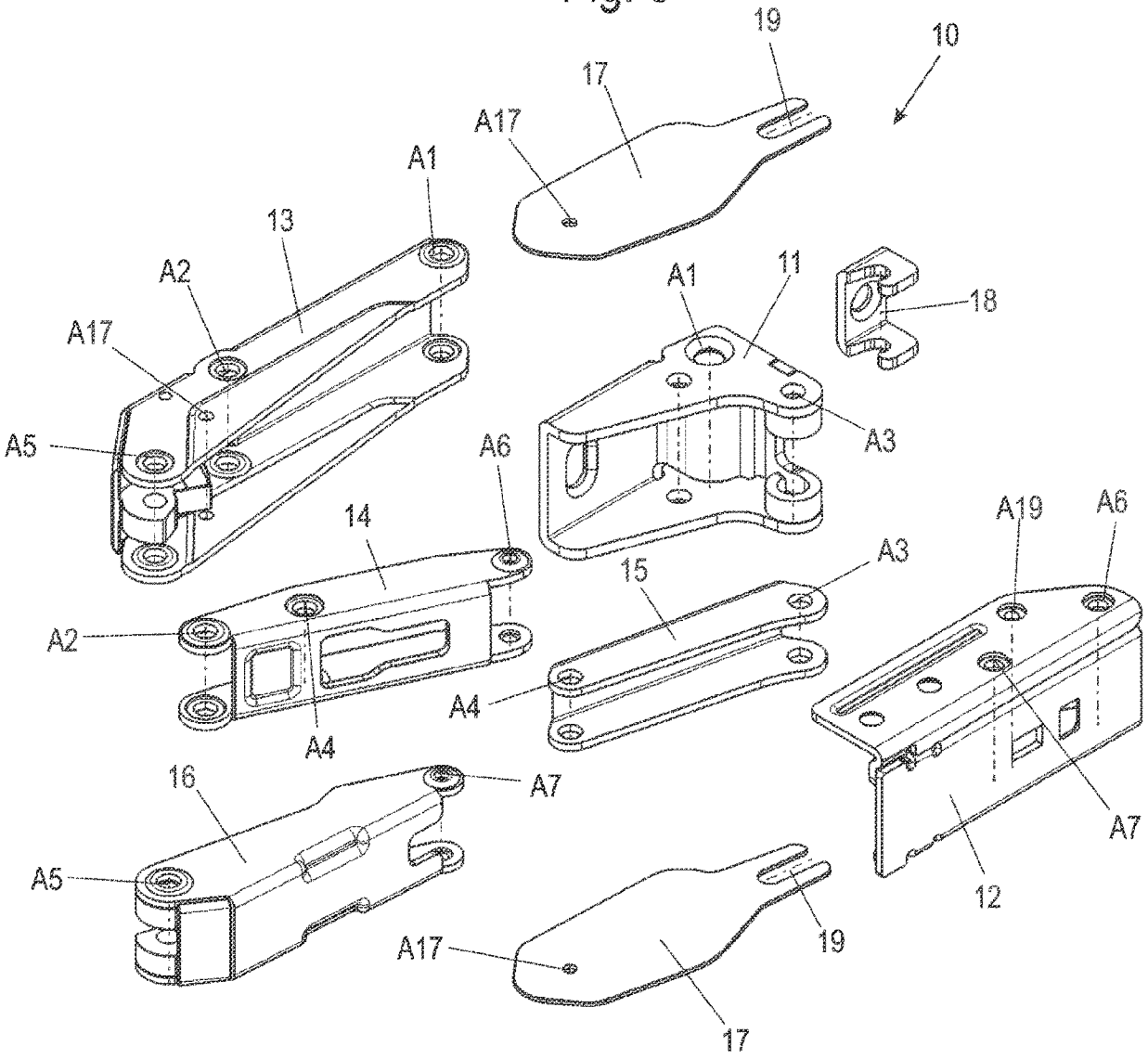
FIG. 5 An exploded view of the support hinge of FIGS. 4A to 4C.

FIG. 5 shows an exploded view of the support hinge. The joint levers 13, 14, 15 and 16 are manufactured as bent sheet steel parts and have a U-shaped cross-section. This achieves a high rigidity of the joint mechanism, as the two legs are connected to each other via an integrally formed base at each joint lever 13, 14, 15 and 16.

The first joint lever 13 is mounted on the mounting element 11 via an axis A1 and has two further axes A2 and A5. The third joint lever 15 is hingedly mounted on the mounting element 11 on the axis A3, on the protruding end of which an axis A4 is formed which corresponds to the axis A4 on the second joint lever 14. The second joint lever 14 is connected to the first joint lever 13 by axis A2, and on the opposite side to the hinge part 12 via axis A6. The fourth joint lever 16 is connected to the first joint lever 13 by axis A5 and to the hinge part 12 via axis A7. The hinge part 12 comprises a bracket and a bearing element which are connected to each other via axes A6 and A7. This facilitates the assembly. Optionally, the hinge part 12 can be formed in one piece, for example as a U-shaped bent component.

The axes A1 to A7 can be formed by pins which are inserted into the respective openings on the joint levers 13 to 16.

The two covers 17 are rotatably held on the first joint lever 13 by an axis A17. Each cover 17 comprises a slot 19 which surrounds an axis A19 provided on the hinge part 12. This allows the axis A19 to be moved along the slot 19.

The support hinge 10 further comprises a height adjustment means, wherein the mounting element 11 is not directly fixed to the appliance body 2 or 2', but via a height adjustment element 18. This allows the mounting element 11, and thus the support hinge 10, to be adjusted in height relative to the height adjustment element 18 in order to align with the appliance body 2 or 2'.

Figure 6A:
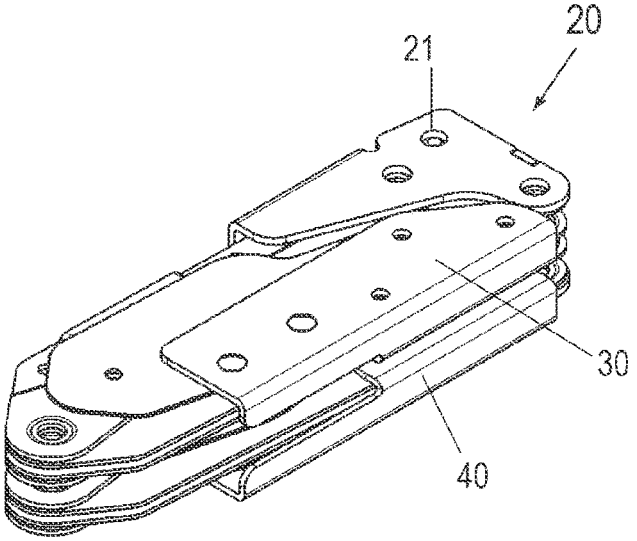
FIGS. 6A to 6C Multiple views of a double hinge of the refrigerator in the closed position.
Figure 6B:
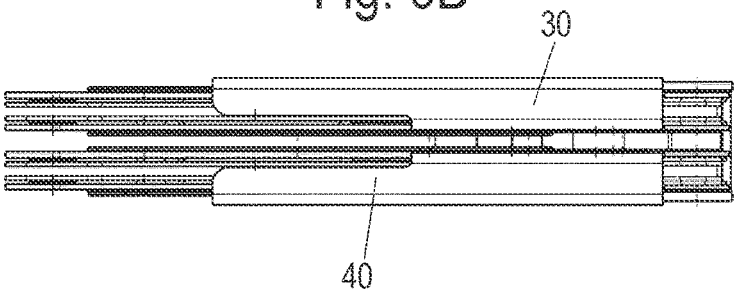
Figure 6C:
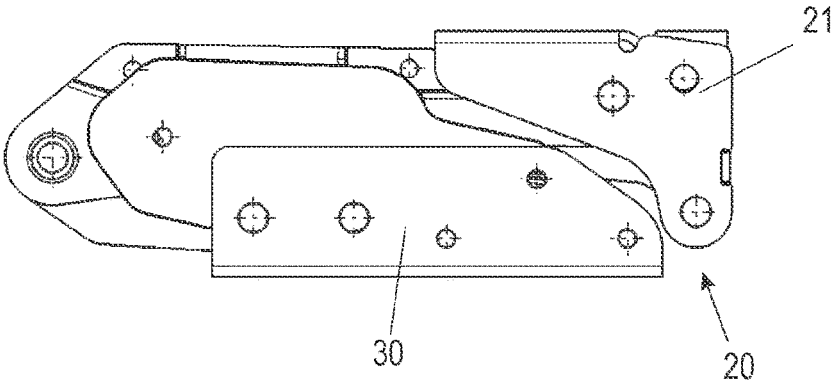

FIGS. 6A to 6C show the double hinge 20 in a closed position. The double hinge 20 is also box-shaped in the closed position. The two hinge parts 30 and are arranged one above the other and next to the mounting plate 21. The mounting plate 21 is formed as a U-shaped bent sheet metal part. The hinge part 30 is connected to the mounting plate 21 via an upper joint mechanism and the hinge part 40 via a lower joint mechanism.

Figure 7A:
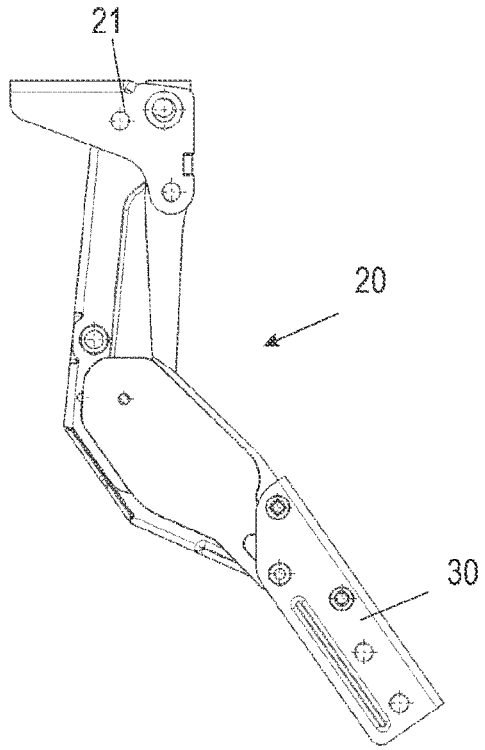
FIGS. 7A and 7B Two views of the double hinge in different opening positions.
Figure 7B:
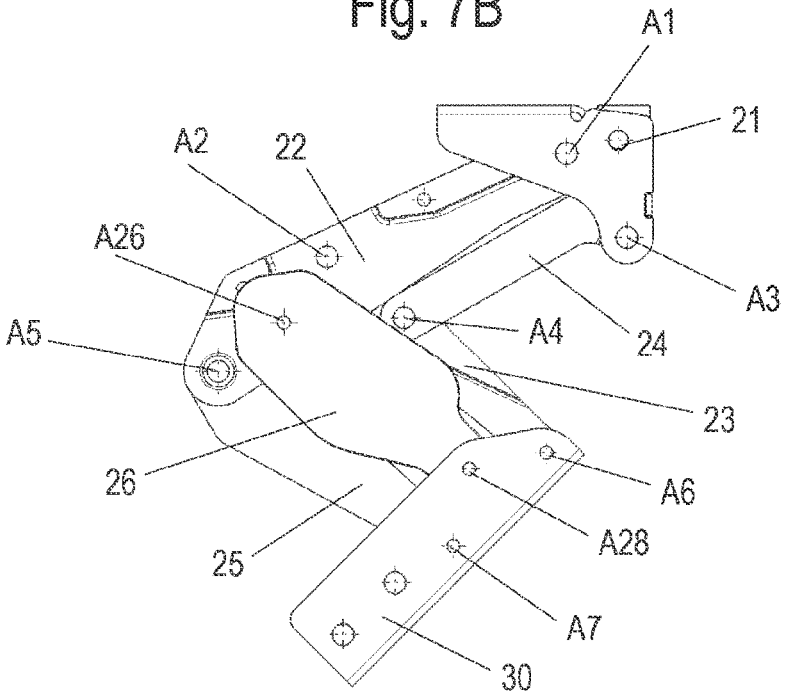

In FIGS. 7A and 7B, the double hinge 20 is shown in different opening positions, in which both hinge parts 30 and 40 are shown lying on top of each other and in FIG. 7A in a maximum opening position. The hinge parts 30 and 40 are arranged at a distance from the mounting plate 21, for example at a distance between 10 mm to 80 mm, in particular 20 mm to 50 mm.

Figure 8A:
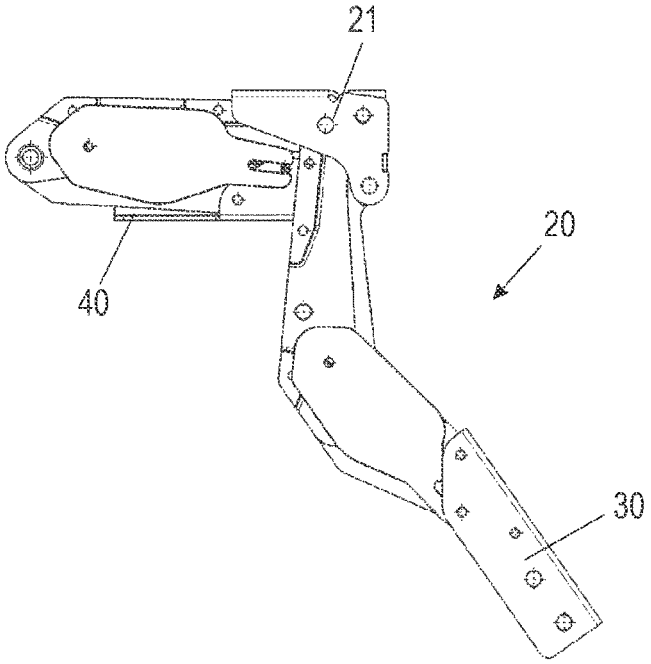
FIGS. 8A and 8B Two views of the double hinge with only one joint mechanism in one opening position.
Figure 8B:
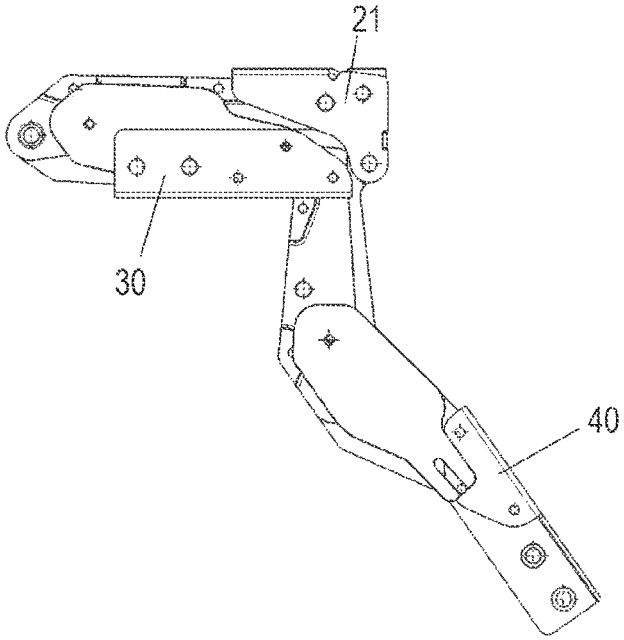

In FIG. 8A, the lower hinge part 40 is in a closed position while the upper hinge part 30 is in the maximum open position. In FIG. 8B, on the other hand, the upper hinge part 30 is arranged in a closed position, while the lower hinge part 40 is arranged pivoted in a maximum open position. The two hinge parts 30 and 40 can thus each be moved independently of each other via an joint mechanism and are held on the stationary mounting plate 21.

Figure 9:
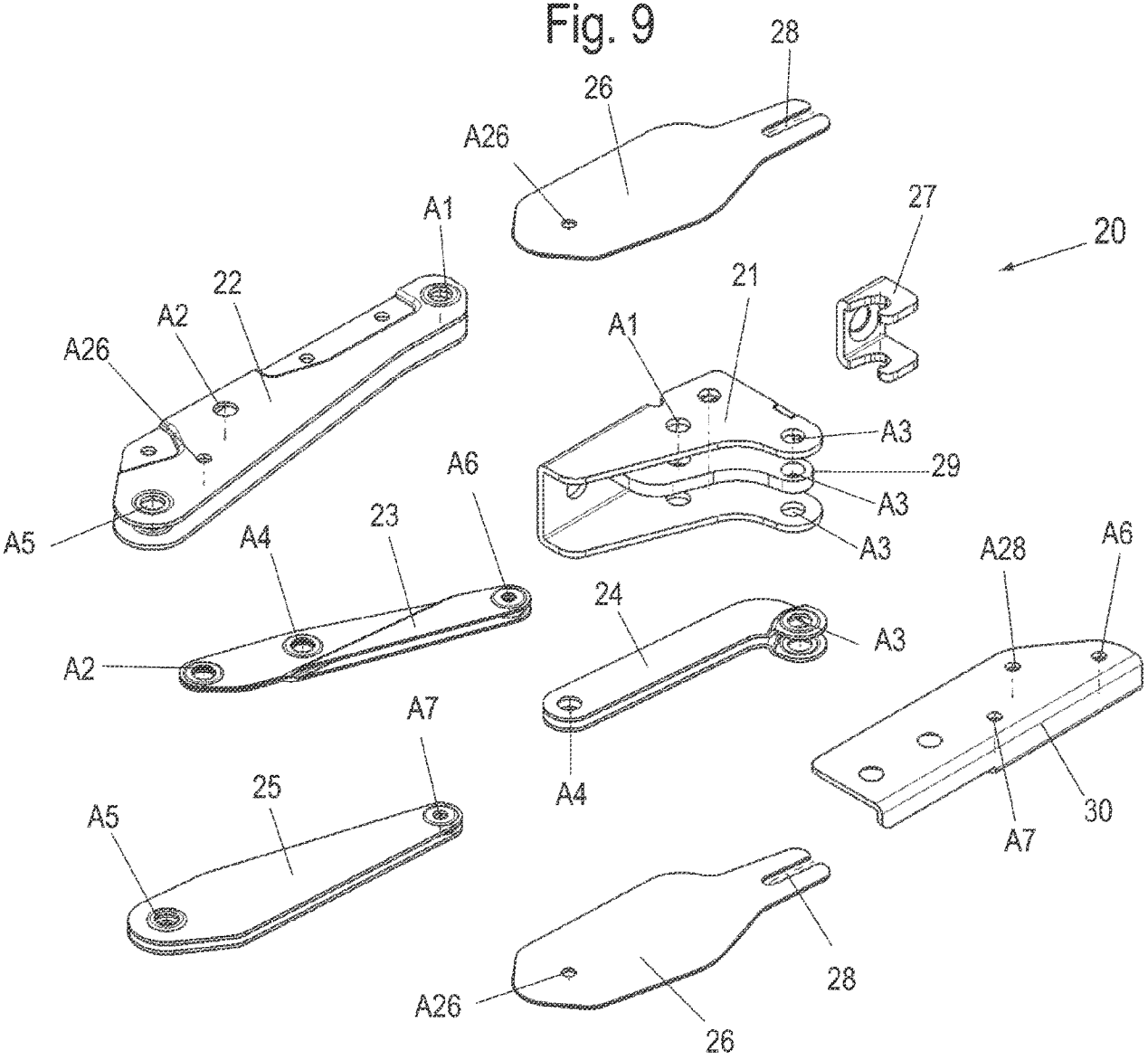
FIG. 9 An exploded view of part of the double hinge of FIGS. 6A to 6C.

FIG. 9 shows the upper joint mechanism of the upper hinge part 30 of the double hinge 20, wherein the upper joint mechanism and the lower joint mechanism of the hinge part 40 are substantially identical in construction, for example mirror-inverted to a central horizontal plane.

The mounting plate 21 is U-shaped and comprises a plate-shaped bottom which can be fixed to the appliance body 2 or 2'. The bottom of the mounting plate 21 can also be fixed to the floor 5 or 5' for dividing the interior spaces 3 and 4.

The joint mechanism comprises four joint levers 22, 23, 24 and 25, by means of which the upper hinge part 30 is pivotably mounted. The first joint lever 22 is hingedly connected to the mounting plate 21 via an axis A1 and comprises two further axes A2 and A5. The third joint lever 24 is hingedly connected to the mounting plate 21 via an axis A3 and is hingedly connected to the second joint lever 23 at the opposite end via an axis A4. The second joint lever 23 is hingedly connected to the first joint lever 22 via axis A2 and is hingedly connected to the hinge part 30 via an axis A6. The axis A4 is located between the axes A2 and A6. The fourth joint lever 25 is hingedly connected to the first joint lever 22 via axis A5 and at the opposite end is hingedly connected to the hinge part 30 via an axis A7. In the assembled position of the double hinge 20, the axes A1 to A7 are mounted in the same way as the axes A1 to A7 on the support hinge 10, only vertically offset.

The double hinge 20 comprises covers 26 on the joint mechanism with the joint levers 22, 23, 24 and 25 on the upper side and the lower side, each cover 26 being hingedly fixed to an axis A26 on the first joint lever 22. The cover 26 comprises a slot 28 into which an axis A28 on the hinge part is inserted, thus guiding the cover 26 during a pivoting movement of the double hinge 20.

The double hinge 20 further comprises a height adjustment means, wherein the mounting plate 21 is not directly fixed to the appliance body 2 or 2', but via a height adjustment element 27. This allows the mounting plate 21 to be adjusted in height relative to the height adjustment element 27 to align with the appliance body 2 or 2'.

The joint levers 22, 23, 24 and 25 are relatively flat compared to the U-shaped joint levers 13, 14, 15 and 16 of the support hinge 10. Preferably, the joint levers 22, 23, 24 and 25 are formed from two plates, in particular a steel plate, which rest on each other at least in some areas. For example, the joint lever 22 comprises two plates which lie on top of each other in areas and are spaced apart in other areas. The spaced areas can be arranged parallel to each other. This increases the bending stiffness despite the small thickness of the joint lever 22. The joint lever 23 is also formed of two plates which rest on each other in some areas and on which a step is formed so that the plates are spaced apart in some areas. The joint levers 24 and 25 comprise two spaced plates, between which a spacer can optionally be provided. A height of the joint levers 22, 23, 24 and 25 in the vertical direction is preferably in a range smaller than 10 mm, in particular smaller than 8 mm. The height of the joint levers 22, 23, 24 and 25 can, for example, be between 2 mm and 7 mm.

An axis holder 29 is arranged on the mounting element 21 between the upper joint levers for the upper door and the joint hinge levers for the lower door. The axis holder 29 is plate-shaped and extends parallel to the two outer walls of the mounting element 21. Openings are provided in the axis holder 29 for the axes A1 and A3 to pass through, at which the first and third joint levers 22 and 24 can be pivoted.

Figure 10:
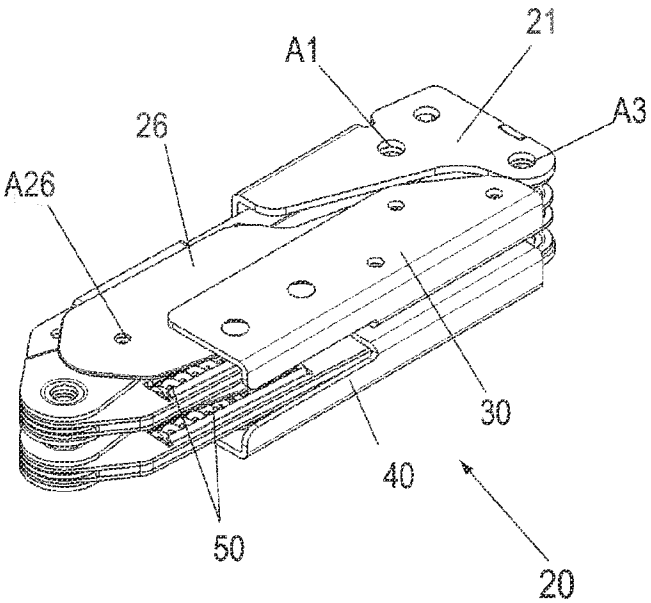
FIG. 10A perspective view of a modified double hinge.

FIG. 10 shows a modified double hinge 20 which comprises a spring 50 on each joint mechanism to bias one of the doors 6 or 7 in the closing direction in a closing area. Each spring 50 can be effective, for example, in an opening area of the door 6 or 7 between the closed position and a pivoting of the hinge part 30 or 40 up to, for example, 30°, in order to bias the door 6 or 7 into the closed position only in this closing area.

Figure 11:
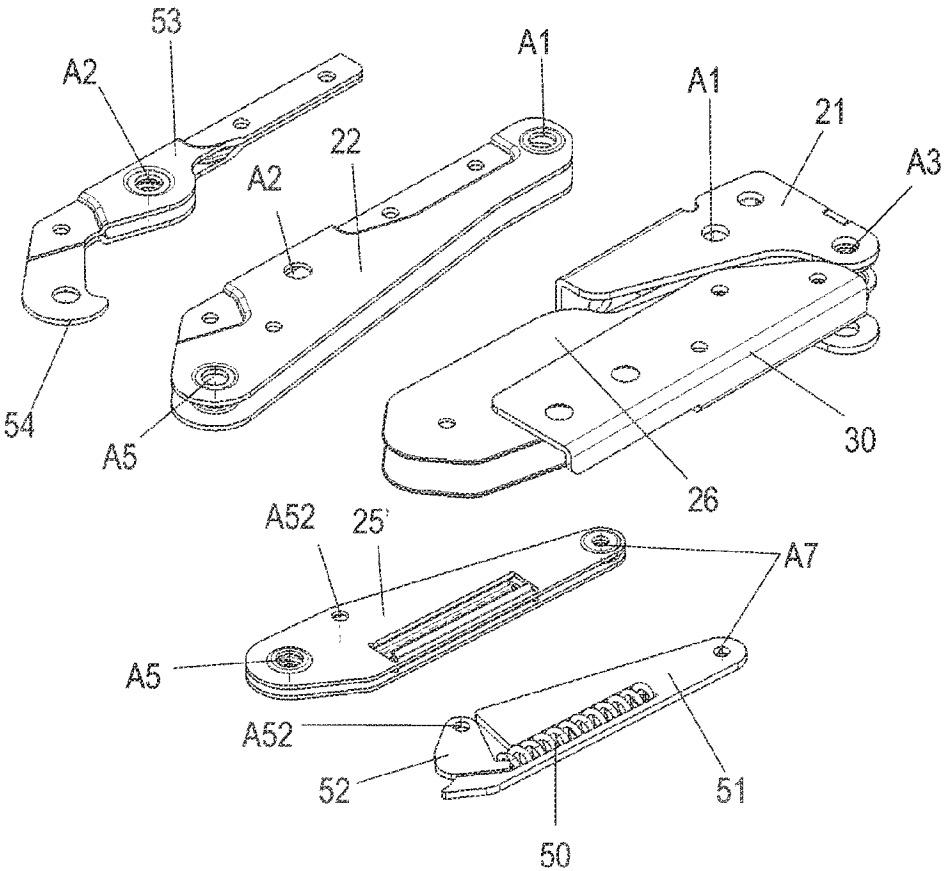
FIG. 11 An exploded view of part of the double hinge of FIG. 10.

FIG. 11 shows the double hinge of FIG. 10 with an joint mechanism for the hinge part 30. A guide lever 53 is fixed to the first joint lever 22 and forms a curve guide 54 at one end. A lever 52, which is rotatably mounted about an axis A52 on a modified fourth joint lever 25', rests against the curve guide 54. A tension lever 51 is provided on the fourth joint lever 25', on which a spring 50 is received in a recess. In the assembled position, the spring 50 also lies in a recess of the fourth joint lever 25'. The tensioning lever 51 is rotatably mounted about the axis A7 of the fourth joint lever 25', whereby the spring 50 can be compressed via the lever 52.

Figure 12B:
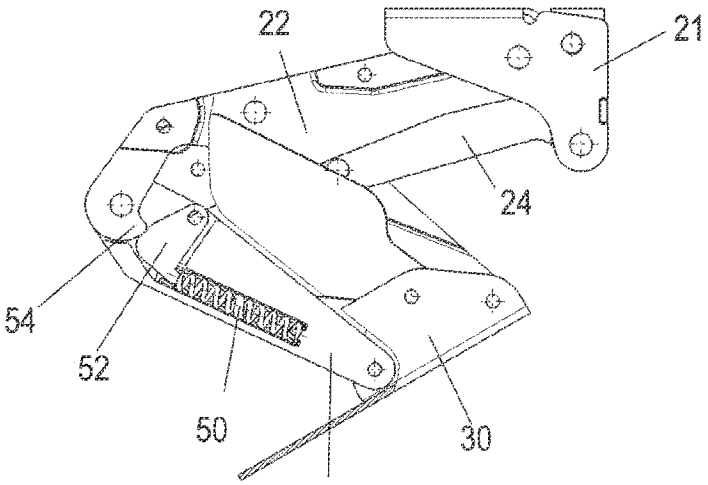
FIGS. 12A to 12C Several views of the double hinge of FIG. 10 in different positions, and FIGS. 13A to 13C Several views of a further double hinge in different positions, and FIGS. 14A and 14B Two views of a refrigerator integrated into a piece of furniture.
Figure 12C:
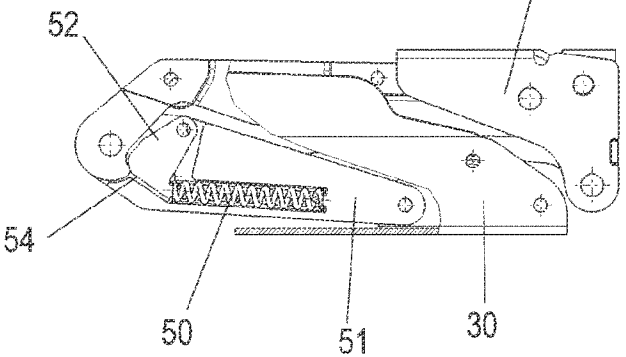
Figure 12A:
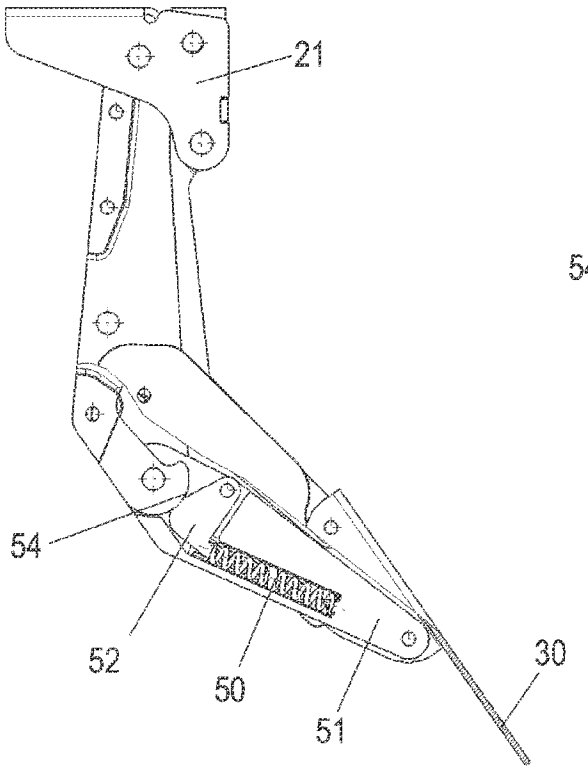

FIG. 12A shows the double hinge with the spring 50 in the maximum opening position of the hinge part 30. The spring 50 is in the tensioned compressed position and the lever 52 pushes the spring 50 into the tension lever 51. A pin or other guide element may be provided in the tension lever 51 to prevent the spring 50 from moving. When the double hinge 30 is moved in the closing direction, as shown in FIG. 12B, the spring 50 remains in the cocked position and the lever 52 does not initially pivot relative to the cocking lever 51. In this pivoting range, the spring 50 is inoperative except for frictional forces, and the curve guide 54 pushes the lever 52 towards the spring 50, not assisting or braking the pivoting movement due to the constant length of the spring 50.

When the double hinge with the hinge part 30 moves from the position shown in FIG. 12B to the closed position shown in FIG. 12C, an area of the curve guide 54 comes into contact with the lever 52, which allows the lever 52 to pivot so that the spring 50 can relax and pivot the lever 52. In the closed position, the spring 50, which is in the form of a compression spring, has a greater length than in the central open position shown in FIG. 12B, so that the closing action of the double hinge is assisted in the closing area.

In FIGS. 10 to 12, the spring 50 is coupled to the pivoted lever 52. FIGS. 13A to 13C show a modified embodiment of a double hinge 20 in which a spring 50 is inserted into a recess of a joint lever 60 and acts on a movable slider 61. The spring 50 is again a compression spring and presses the pusher 61 against a cam 62 formed on the hinge part 30 or a component fixed to the hinge part 30.

In the closed position of FIG. 13A, the pusher 61 is spaced from the joint lever 60, and when opening, the pusher 61 is moved towards the joint lever 60 by the cam 62 so that the spring 50 is compressed against the spring force. In this compressed and tensioned position, the spring 50 can be moved from the middle opening position according to FIG. 13B to a maximum opening position according to FIG. 13C without changing the length of the spring 50. The pusher 61 is moved along the curve guide 62.

In an alternative embodiment, the curve guides 54 and 62 can also be formed differently so that the hinge part 30, 40 is pretensioned over the entire travel in the closing direction. It is also possible that the curve guides automatically move the hinge part 30, 40 into an open position from a predetermined opening angle.

Only during a closing movement can the spring 50 in the opening area between FIGS. 13B and 13A relax again and thus bias the door 6 or 7 into the closed position.

In addition to the spring element, a damper can also be provided on the support hinge 10 and/or the double hinge 20 to slow down a closing movement in order to avoid loud impact noises.

Figure 14A:
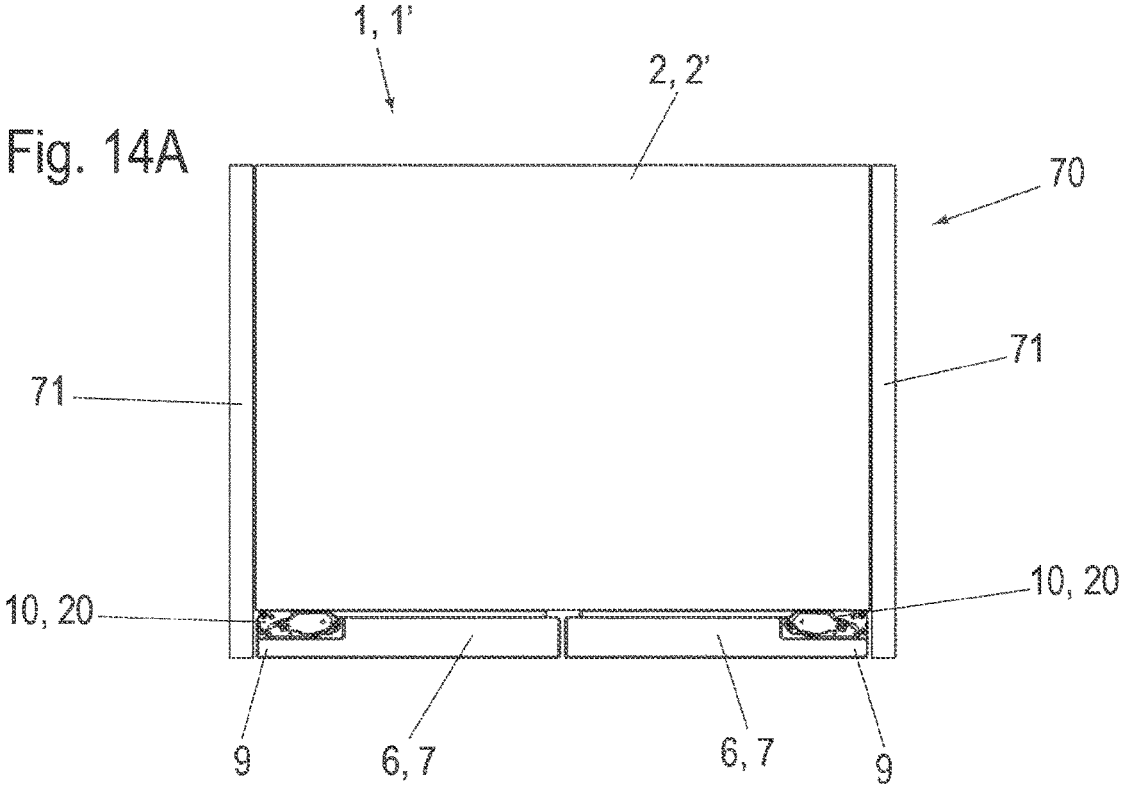
Figure 14B:
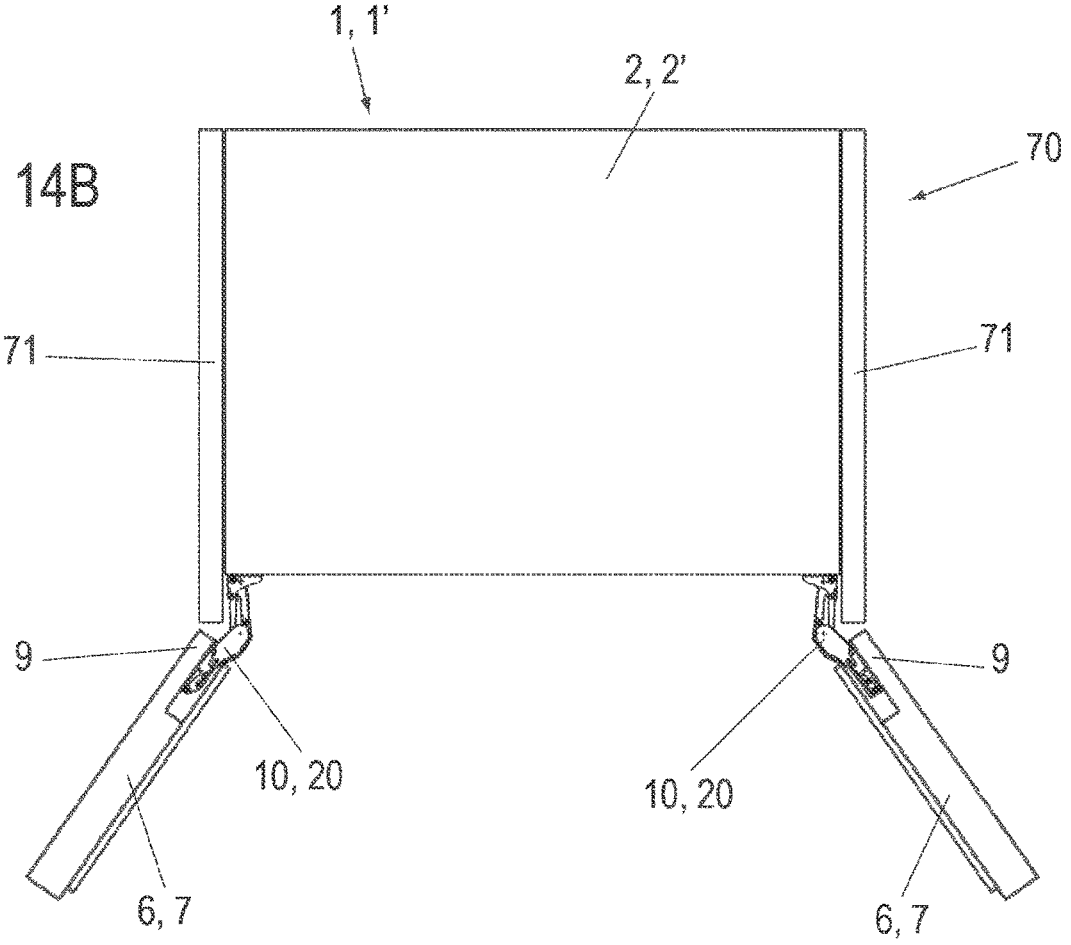

FIGS. 14A and 14B show a refrigerator 1, 1' in a closed and open door position, in which the appliance body 2, 2' is integrated in a piece of furniture 70.

The furniture has two side walls 71 which project beyond the appliance body 2, 2' at the front, so that the front of the doors 6 and 7 are flush with the narrow side of the side walls 71 in the closed position. In the closed position, the side face 9 of the doors 6 and 7 is thus concealed from a side view by the side walls 71. In the fully open door position, the narrow side of the side panel 71 and the lateral end face 9 of the doors 6, 7 are at an angle to each other. In FIGS. 14A and 14B, the refrigerator 1, 1' has two opposing doors 6 and 7. However, the refrigerator 1, 1' can also have only one door 6 and one door 7.

Due to the arrangement with a support hinge 10 and a double hinge 20, high door weights can be realised so that the doors 6 and 7 can also have different or combined additional functions such as an ice cube area, a beverage flap, interior organisation or a touch screen.

In addition to a damping device for the closing process of the door 6,7, an electronic opening aid can also be provided on the refrigerator 1, 1' to assist the operator in opening the door 6,7 or to open the door 6,7 at least partially.

LIST OF REFERENCE SIGNS

1, 1' Refrigerator
2, 2' Appliance body
3, 3' Interior space
4, 4' Interior space
5, 5' Floor
6 Door
7 Door
8 Seal
9 Front side
10 Support hinge
11 Mounting element
12 Hinge part
13 Joint lever
14 Joint lever
15 Joint lever
16 Joint lever
17 Cover
18 Height adjustment element
19 Slot
20 Double hinge
21 Mounting plate
22 Joint lever
23 Joint lever
24 Joint lever
25, 25' Joint lever
26 Covering
27 Height adjustment element
28 Slot
29 Axis holder
30 Hinge part
40 Hinge part
50 Spring
51 Tensioning lever
52 Lever
53 Guide lever
54 Curve guide
60 Joint lever
61 Pusher
62 Curve guide
70 Furniture
71 Sidewall
H Height
H Height
A1 Axis
A2 Axis
A3 Axis
A4 Axis
A5 Axis
A6 Axis
A7 Axis
A17 Axis
A19 Axis
A26 Axis
A28 Axis
A52 Axis

The invention claimed is:

1. A refrigerator (1, 1') with an appliance body (2, 2'), on which at least two doors (6, 7) arranged one above the other are pivotably mounted, which open or close an interior space (3, 4) of the appliance body (2, 2'), a) wherein the doors (6, 7) are connected to the appliance body (2, 2') in a closed position via at least one seal (8), b) wherein the two doors (6, 7) form an upper door (6) and a lower door (7) and are pivotably mounted via a double hinge (20) which is fixed to the appliance body (2, 2') with a mounting plate (21) which is connected via a plurality of movable joint levers (22, 23, 24, 25) to an upper hinge part (30) connected to the upper door (6) and via a plurality of further movable joint levers to a lower hinge part (40) connected to the lower door (7), c) wherein the upper door (6) is further pivotably mounted on the appliance body (2, 2') via a support hinge (10) which is fixed to the appliance body (2, 2') with a mounting element (11) which is connected to a further upper hinge part (12) connected to the upper door (6) with a plurality of further joint levers (13, 14, 15, 16), d) wherein the lower door (7) is pivotably mounted on the appliance body (2, 2') in an upper area via the double hinge (20) and in a lower area via a further support hinge (10) and the further support hinge (10) is of identical construction to the support hinge (10) with which the upper door (6) is pivotably mounted on the appliance body (2 2'), wherein the joint levers (13, 14, 15, 16) of the support hinge (10) have a greater vertical extension than the joint levers (22, 23, 24, 25) of the double hinge (20), wherein the support hinge (10) comprises a support lever hinged to the mounting element (11), the support lever being formed by one of the further joint levers (13, 14, 15, 16) that has a greatest extension in a vertical direction of the further joint levers, and wherein the support lever is at least twice as thick as one of the joint levers (22, 23, 24, 25) of the double hinge (20) which is hinged to the mounting plate (21) and has the greatest extension in the vertical direction of the joint levers (22, 23, 24, 25) of the double hinge (20).

2. The refrigerator according to claim 1, wherein the support hinge (10) absorbs more weight forces of the upper door (6) than a part of the double hinge (20) connected to the upper door (6).

3. The refrigerator according to claim 1, wherein the joint levers (22, 23, 24, 25) of the double hinge (20) and the joint levers (13, 14, 15, 16) of the support hinge (10) have the same axes of rotation and the same lever lengths.

4. The refrigerator according to claim 1, wherein the joint levers (22, 23, 24, 25) of the double hinge (20) and the joint levers (13, 14, 15, 16) of the support hinge (10) have unequal axes of rotation and unequal lever lengths.

5. The refrigerator according to claim 1, wherein the joint levers (22, 23, 24, 25) of the double hinge (20) are at least partially plate-shaped and at least outer joint levers (13, 16) of the support hinge (10) are formed as levers which are U-shaped in cross-section.

6. The refrigerator according to claim 1, wherein the support hinge (10) has a greater height in a vertical direction than a height of the double hinge (20).

7. The refrigerator according to claim 1, wherein the joint levers (22, 23, 24, 25) of the double hinge (20) are formed at least partially from at least two plates which lie one on top of another in certain areas.

8. The refrigerator according to claim 7, wherein the at least two plates form a cavity into which a further joint lever (22, 23, 24, 25) projects.

9. The refrigerator according to claim 1, wherein a plate-shaped cover (17, 26) for covering gaps between the joint levers (13, 14, 15, 16, 22, 23, 24, 25) is provided on an upper side and a lower side of the support hinge (10) and/or the double hinge (20).

10. The refrigerator according to claim 1, wherein the joint levers (22, 23, 24, 25) on the double hinge (20) form an articulated lever mechanism with seven joints.

11. The refrigerator according to claim 1, wherein at least one of the joint levers of the double hinge (20) has a recess into which a spring (50) is inserted, by means of which a hinge part (30, 40) can be pretensioned in a closing direction.

12. The refrigerator according to claim 11, wherein the spring (50) acts on a pivotable lever (52) or a pusher (61) which is movable along a curve guide (54, 62).

13. The refrigerator according to claim 1, wherein an axis holder (29) for common axes (A3, A1) is arranged on the mounting plate (21) between the joint levers (22, 24) for the upper door (6) and the joint levers (22, 24) for the lower door (7).

14. The refrigerator according to claim 13, wherein the joint levers (22, 24) for the upper door (6) and the joint levers (22, 24) for the lower door (7) are held on the mounting plate (21) and the axis holder (29) via a common axis bolt.

15. The refrigerator according to claim 1, wherein the upper door (6) and the lower door (7) are braked by a damping device during a closing process, the damping device comprising a linear damper with a piston or a rotary damper, the damper being filled with a fluid.

16. The refrigerator according to claim 1, wherein the appliance body (2, 2') is integrated in a piece of furniture (70) with side walls (71), the side walls (71) of the piece of furniture (70) projecting beyond the appliance body (2, 2') and covering at least part of lateral end faces (9) of the doors (6, 7) from the side.

17. The refrigerator according to claim 1, wherein at least one door (6, 7) on a side facing the interior space (3, 4) has, in addition to insulation, compartments and/or holding means for storing objects and the support hinge (10) allows an opening angle of at least 115° so that the interior space (3, 4) is at least almost completely freely accessible.

* * * * *